US012371886B2

(12) United States Patent
Romero

(10) Patent No.: US 12,371,886 B2
(45) Date of Patent: Jul. 29, 2025

(54) FAUCET ASSEMBLY INCLUDING QUICK INSTALLATION FASTENER, AND METHOD OF INSTALLATION OF A FAUCET

(71) Applicant: ASSA ABLOY Americas Residential Inc., New Haven, CT (US)

(72) Inventor: Oscar Romero, Lake Forest, CA (US)

(73) Assignee: ASSA ABLOY Americas Residential Inc., New Haven, CT (US)

( * ) Notice: Subject to any disclaimer, the term of this patent is extended or adjusted under 35 U.S.C. 154(b) by 129 days.

(21) Appl. No.: 17/942,416

(22) Filed: Sep. 12, 2022

(65) Prior Publication Data

US 2023/0081301 A1 Mar. 16, 2023

Related U.S. Application Data

(60) Provisional application No. 63/244,486, filed on Sep. 15, 2021.

(51) Int. Cl.
*E03C 1/04* (2006.01)

(52) U.S. Cl.
CPC ..... *E03C 1/0402* (2013.01)

(58) Field of Classification Search
CPC ..... E03C 1/04; E03C 1/0401; E03C 1/0402
USPC ..... 4/675–678
See application file for complete search history.

(56) References Cited

U.S. PATENT DOCUMENTS

| | | | |
|---|---|---|---|
| 5,118,237 | A | 6/1992 | Wright |
| 5,340,252 | A | 8/1994 | Weddendorf |
| 5,902,085 | A | 5/1999 | Yuta |
| 6,974,291 | B2 | 12/2005 | Li |
| 7,735,667 | B2 | 6/2010 | Schutz |
| 8,231,318 | B2 | 7/2012 | Pitsch et al. |
| 8,272,083 | B1 | 9/2012 | Liston et al. |
| 8,534,974 | B2 | 9/2013 | Smith |
| 8,708,629 | B2 | 4/2014 | Smith |
| 9,212,474 | B2 | 12/2015 | Ye et al. |
| 9,222,245 | B2 | 12/2015 | Ye et al. |
| 9,637,893 | B2 | 5/2017 | Lin et al. |
| 10,428,496 | B1 | 10/2019 | Lu et al. |
| 10,724,215 | B2 | 7/2020 | Darocha et al. |
| 10,937,421 | B2 | 3/2021 | Beck et al. |
| 11,208,791 | B2 | 12/2021 | Darocha et al. |

(Continued)

FOREIGN PATENT DOCUMENTS

| | | |
|---|---|---|
| CN | 201206582 | 3/2009 |
| CN | 202756387 | 2/2013 |

(Continued)

*Primary Examiner* — Tuan N Nguyen
(74) *Attorney, Agent, or Firm* — Merchant & Gould P.C.

(57) ABSTRACT

A faucet assembly and method of faucet installation are provided. In one example, a faucet assembly includes a fastener including a cylindrical aperture formed, at least in part, by an interior surface that has a complementary threading to a threaded exterior surface of a shank of a faucet. The fastener is manually adjustable to change a relative posture between the interior surface and the threaded exterior surface of the shank when positioned around the shank between a first posture and a second posture. In the first posture, the interior surface is positioned away from the shank and the fastener is freely slidable along the threaded exterior surface of the shank in the first direction, and in the second posture, the portion of the interior surface including the complementary threading is adjacent to and engaged with the threaded exterior surface of the shank.

14 Claims, 10 Drawing Sheets

(56) References Cited

U.S. PATENT DOCUMENTS

| | | | |
|---|---|---|---|
| 11,585,367 | B2 | 2/2023 | Ma et al. |
| 11,644,060 | B2 | 5/2023 | Ma et al. |
| 11,644,061 | B2 | 5/2023 | Yu et al. |
| 2006/0101576 | A1 | 5/2006 | Rhodes |
| 2020/0063408 | A1 | 2/2020 | Tracy et al. |
| 2021/0087800 | A1 | 3/2021 | Benstead |
| 2022/0228622 | A1 | 7/2022 | Sapp et al. |
| 2023/0075627 | A1 | 3/2023 | Wang et al. |
| 2023/0134740 | A1 | 5/2023 | Keller |
| 2024/0052611 | A1 | 2/2024 | Muehling |

FOREIGN PATENT DOCUMENTS

| | | |
|---|---|---|
| CN | 203129257 | 8/2013 |
| CN | 203362784 | 12/2013 |
| CN | 203906508 | 10/2014 |
| CN | 204961535 | 1/2016 |
| CN | 106151225 | 11/2016 |
| CN | 107345415 | 11/2017 |
| CN | 206929420 | 1/2018 |
| CN | 108413092 | 8/2018 |
| CN | 208330957 | 1/2019 |
| CN | 208565220 | 3/2019 |
| CN | 110725368 | 1/2020 |
| CN | 212271108 | 1/2021 |
| CN | 216130256 | 3/2022 |
| CN | 216405593 | 4/2022 |
| CN | 219671533 | 9/2023 |
| CN | 220204334 | 12/2023 |
| EP | 3786374 | 3/2021 |
| EP | 4230886 | 8/2023 |
| JP | 6978352 | 12/2021 |
| KR | 200497245 | 5/2023 |
| WO | 2021/082539 | 6/2021 |

FAUCET ASSEMBLY INCLUDING QUICK INSTALLATION FASTENER, AND METHOD OF INSTALLATION OF A FAUCET

CROSS-REFERENCE TO RELATED APPLICATIONS

This application claims priority to and the benefit of U.S. Provisional Patent Application No. 63/244,486, filed Sep. 15, 2021, the disclosure of which is hereby incorporated by reference herein in its entirety.

BACKGROUND

Kitchen and bathroom faucets typically have an above counter (or above sink) base portion having a faucet body extending therefrom, as well as a threaded shank that extends down through a countertop or sink. To install such faucets, typically an installer will slide a shank into a hole in the countertop or sink, and will then thread a nut onto the shank to affix the faucet to the countertop or sink surface. At that point, the installer may connect supply hoses, which typically will be routed through the shank and into the faucet body.

Because a thickness of a countertop or sink may vary widely, the threaded shank may typically extend 3 to 5 inches or more downward from the base portion of the faucet. This means, once the shank is fed through a hole in the countertop or sink surface, a significant amount of the shank will extend downward from an underside of the countertop or sink.

When an installer wishes to thread a nut onto the shank, the installer must initially slide the nut over the supply hoses, and subsequently rotate the nut to cause the nut to thread onto the shank. The nut must then be rotated until it moves axially upward along the shank to a location that is snug against the underside of the countertop or sink. This may require a significant amount of effort by the installer, since the nut may need to be rotated a large number of times to cause the nut to traverse the vertical distance from the end of the shank to the underside of the countertop or sink.

This installation difficulty is exacerbated by the fact that, in most kitchen and bath installations, a location of the shank is toward the back of a countertop or sink, and within a cramped under-sink cabinet space. Often, the installer must utilize a pipe wrench to repeatedly turn the nut. Because of the cramped space typically available in such installations, such a pipe wrench may only have available space to allow for a small fraction of a rotation, which must be repeated many times to complete a single installation. Accordingly, installation of new faucets can be highly inconvenient and time-consuming.

SUMMARY

In general, the present disclosure is directed to embodiments of fasteners that are used with faucet installations that have threaded shanks. In examples, the fasteners disclosed herein are selectively adjustable between thread engaging postures and threaded disengaged postures. Such fasteners may be installed over a shank in a thread disengaged posture, to allow the fastener to be slid along the length of the shank until an underside of the countertop is approached. The fastener may then be adjusted to a thread engaged posture, in which the fastener may subsequently be tightened against the underside of the countertop, thereby completing the mechanical mounting of the faucet to the countertop.

In a first aspect, a faucet assembly is provided. The faucet assembly includes a faucet having a faucet body comprising a base and a spout, as well as a cylindrical shank extending from the base and having one or more water supply lines extending therethrough between the spout and a water supply. The shank defines a central axis extending in a first direction and includes a threaded exterior surface. The faucet assembly further includes a fastener including a cylindrical aperture formed, at least in part, by an interior surface, where at least a portion of the interior surface includes a complementary threading to the threaded exterior surface of the shank, the fastener being manually adjustable to change a relative posture between the interior surface and the threaded exterior surface of the shank when positioned around the shank between a first posture and a second posture. In the first posture, the interior surface is positioned away from the shank and the fastener is freely slidable along the threaded exterior surface of the shank in the first direction. In the second posture, the portion of the interior surface including the complementary threading is adjacent to and engaged with the threaded exterior surface of the shank.

In a second aspect, a method of installing a faucet including a faucet body comprising a base, a spout, and a cylindrical shank extending from the base, is disclosed. The method includes inserting the cylindrical shank of the faucet through a hole in a mounting surface, the mounting surface being one of a countertop or a sink, the cylindrical shank having a threaded exterior surface, and sliding one or more water supply lines extending from the cylindrical shank through a cylindrical aperture of a fastener, the cylindrical aperture formed, at least in part, by an interior surface, where at least a portion of the interior surface includes a complementary threading to the threaded exterior surface of the shank. The method further includes manually positioning the fastener at a first posture relative to the shank, the first posture positioning the interior surface away from the threaded exterior surface of the shank, and, while maintaining the fastener in the first posture, sliding the fastener along the threaded exterior surface of the shank toward an underside of the mounting surface. The method further includes, at a position approaching the underside of the mounting surface, manually adjusting a posture of the fastener from a first posture to a second posture to engage the threaded exterior surface of the shank with the complementary threading of the interior surface. The method also includes tightening the fastener against the underside of the mounting surface by rotating the fastener along the threaded exterior surface, thereby affixing the faucet to the mounting surface.

In a third aspect, a faucet assembly is disclosed including a faucet having a faucet body comprising a base and a spout. The faucet assembly further includes a cylindrical shank extending from the base and having one or more water supply lines extending therethrough between the spout and a water supply, the shank defining a central axis extending in a first direction and including a threaded exterior surface, the threaded exterior surface of the shank having a major diameter. The faucet assembly further includes a fastener including a cylindrical aperture formed, at least in part, by an interior surface, where at least a portion of the interior surface includes a complementary threading to the threaded exterior surface of the shank, the fastener being manually adjustable to change a relative posture between the interior surface and the threaded exterior surface of the shank when positioned around the shank between a first posture and a second posture. In the first posture, the fastener has an interior diameter that, when viewed in a direction along the central axis, that is greater than the major diameter of the shank. In the second posture, the fastener has an interior diameter that, when viewed in a direction along the central axis, is not greater than the major diameter of the shank.

BRIEF DESCRIPTION OF THE DRAWINGS

The following drawing figures, which form a part of this application, are illustrative of the described technology and are not meant to limit the scope of the disclosure in any manner.

DETAILED DESCRIPTION

Figure 1:
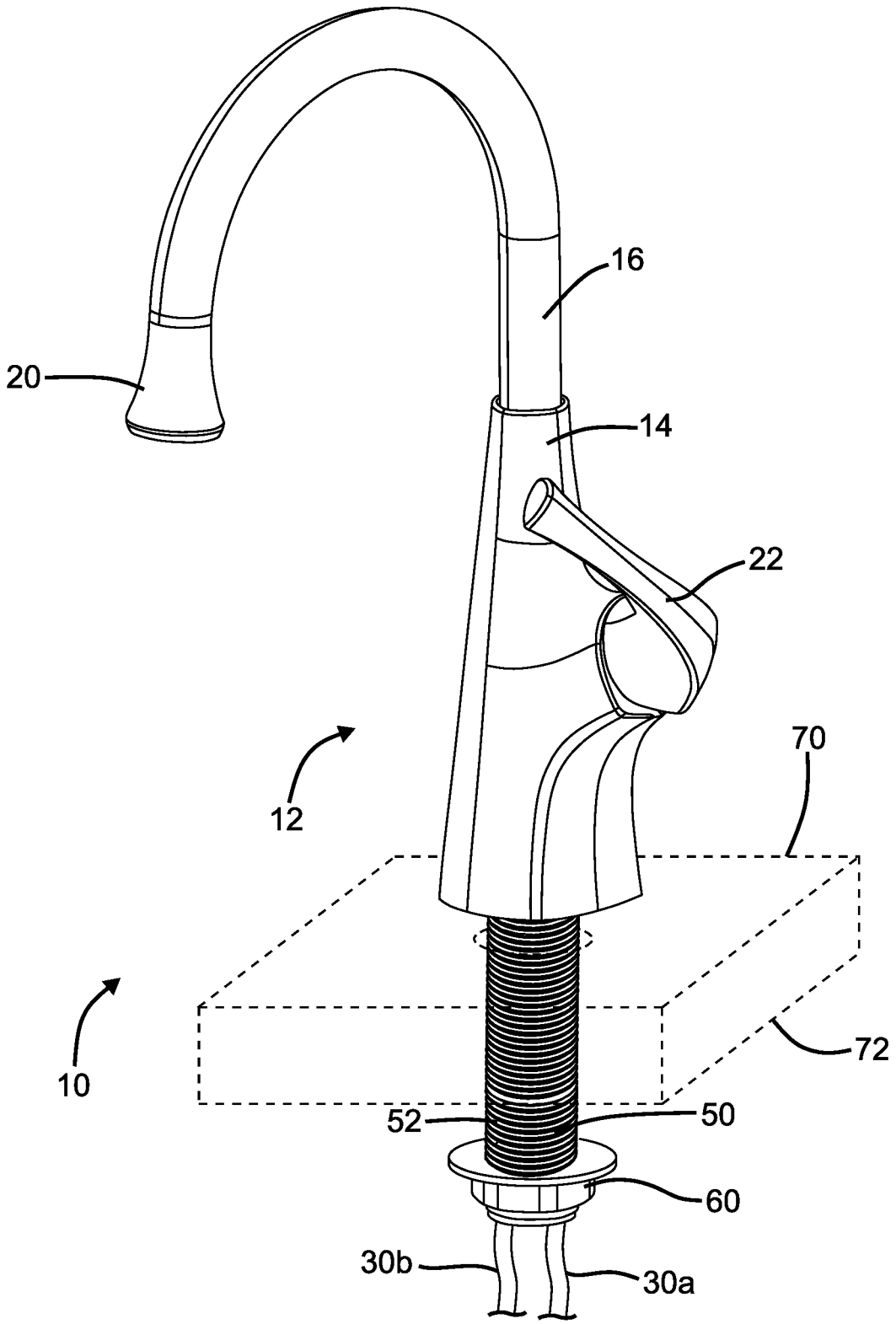
FIG. 1 illustrates an example faucet assembly in which aspects of the present disclosure may be implemented.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

As briefly described above, embodiments of the present invention are directed to a faucet assembly and method of faucet installation that utilize a quick connection fastener to affix a faucet assembly to a mounting surface. The faucet assembly includes a fastener usable to engage a threaded shank of a faucet. The fastener includes a cylindrical aperture that has an internal threading on at least a portion of an interior surface that is complementary to a threaded exterior surface of a shank of a faucet. The fastener is manually adjustable to change a relative posture between the interior surface and the threaded exterior surface of the shank when positioned around the shank between a first posture and a second posture. In the first posture, the interior surface is positioned away from the shank and the fastener is freely slidable along the threaded shank in the first direction, and in the second posture, the portion of the interior surface including the complementary threading is adjacent to and engaged with the threaded exterior surface of the shank.

The use of a fastener and shank according to the embodiments described herein provide a method of installing a faucet at a mounting surface, such as at a sink or countertop, that is comparatively simple and quick to complete. Specifically, the use of a fastener as disclosed herein allows use of a lengthy mounting shank while avoiding the requirement to thread the fastener onto the shank for the entire length of the shank exposed at the underside of the mounting surface. Rather, in typical installations, an installer will only be required to rotate the fastener for 1-2 rotations to tighten the fastener against an underside of the mounting surface.

In example aspects, the fastener may be movable between first and second postures by tilting the fastener relative to the shank. By tilting the fastener relative to the shank, portions of an internal surface of the fastener that do not have threating thereon are adjacent to the external threading of the shank, thereby allowing the fastener to slide freely along the threading of the shank. When tilted relative to the threaded shank, the fastener may have an internal diameter that is greater than a major diameter of the threaded shank. However, when in alignment with the threaded shank, the fastener may have threads that engage with the complementary threads of the shank.

In further example aspects, the fastener may include a threaded piece and a locking piece. The threaded piece may include a plurality of tabs having threading on interior surfaces. The locking piece may be movable relative to the threaded piece between locking and unlocked postures. In the unlocked posture, the locking piece may not bias the tabs inwardly, allowing the tabs to remain spaced apart from complementary threading of the shank, thereby allowing the fastener to slide freely along the length of the shank without requiring rotation along the threads. In the locked posture, the locking piece may bias the tabs inwardly, thereby causing the threading on interior surfaces of the tabs to engage with the complementary threading of the shank.

Referring first to FIG. 1, an example faucet assembly 10 is shown including a faucet 12. The faucet 12 includes a faucet body including a base 14 and spout 16. In the example shown, the faucet body further includes a spray head 20. In example embodiments, the spray head 20 may be affixed at the end of the spout 16; in alternative embodiments, the spray head 20 may be a pull-out or pull-down spray head. Example spray head configurations are described in U.S. Patent Publication No. 2021/0087800, entitled "Wetted Spout Faucet and Cartridge Seat Assembly for the Same", as well as U.S. Patent Publication No. 2020/0063408, entitled "Faucet Head Alignment System", the disclosures of each of which are hereby incorporated by reference in their entireties.

In the example shown, water flow through the faucet may be controlled, for example, using a handle 22 connected to a valve cartridge (not shown) that is positioned within the base 14. However, a variety of water control methods may be used. For example, an arrangement including two or more handles may be used as well. Alternatively, an electronically actuated faucet may be used, in which a valve cartridge is controlled by electronics interfaced to one or more touch interfaces.

In the example shown, a water supply may be connected to the faucet via supply tubes 30*a-b*. The supply tubes extend into the faucet through a shank 50. In the example shown, the shank 50 extends from the base 14 of the faucet 12, and has threads 52 on an outer surface. In alternative configurations, additional hoses and/or tubes may extend through the shank, such as a hose connecting to a spray head 20 in a pull-down or pull-out faucet, such as seen in U.S. Patent Publication No. 2020/0063408, which was previously incorporated by reference.

Although a faucet having a single handle 22 and a single shank 50 are shown, it is recognized that the present disclosure is consistent with faucets having a variety of configurations. For example, separate hot and cold water controls may be used, each having its own water supply and corresponding shank usable to affix the faucet to a mounting surface, such as a countertop or sink. In such examples, the specific location and size of the shank 50, as well as the number of shanks, may vary. Additionally, separate handles for control of volume of hot and cold water may be supplied, and may be placed spaced apart from the base 14 and/or spout 16. Additionally, the faucet 12 may include one or more smart features such as voice and/or gesture controls, and as such, wiring may also be passed through the shank 50 in addition to the supply tubes 30*a-b* and/or a hose. An example of such a faucet is described in U.S. Pat. No. 10,937,421, entitled "Electronic Faucet with Smart Features", the disclosure of which is also incorporated by reference in its entirety.

Figure 2:
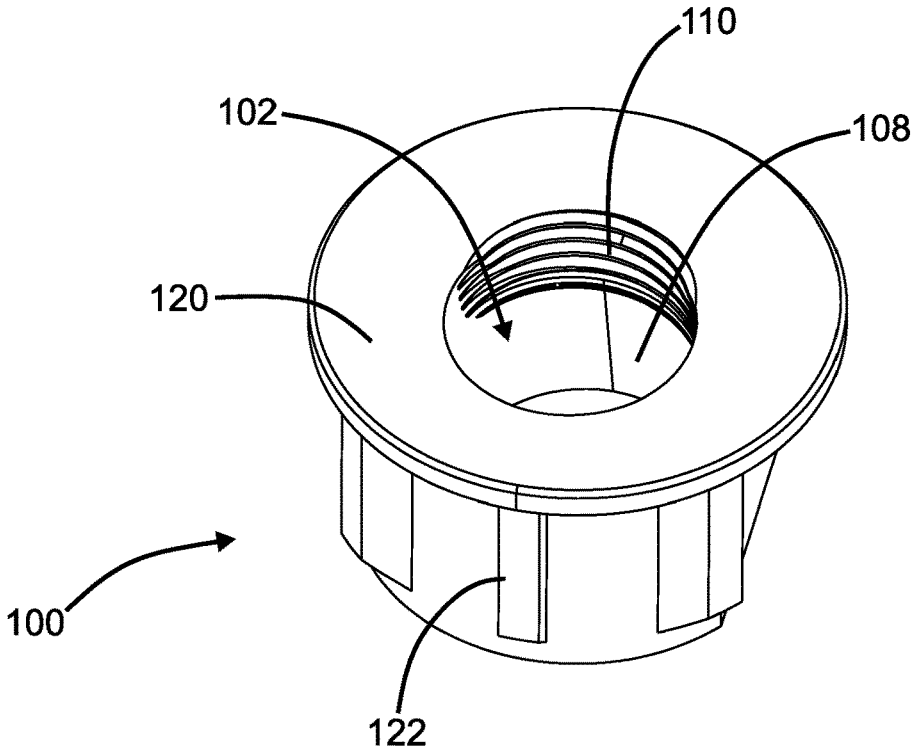
FIG. 2 is an example perspective view of a fastener usable with a threaded shank to mount a faucet to a mounting surface, in accordance with a first example embodiment.

Referring to FIGS. 2-5, a first example embodiment of a fastener 100 is shown, which is usable as the fastener 60 as seen in FIG. 1. Specifically, FIG. 2 is an example perspective view of a fastener 100 usable with a threaded shank (e.g., shank 50) to mount a faucet to a mounting surface, such as a sink or countertop, in accordance with the first example embodiment.

In the example shown, the fastener 100 has a central aperture 102 having an interior surface. In general, the central aperture 102 is sized to fit around the shank 50. The faster includes an engagement surface 120, which can engage against an underside of a mounting surface when the fastener 100 is tightened against the underside 72 of the mounting surface for purposes of retaining a faucet 12 in place on such a mounting surface 70.

In the example shown, the fastener 100 can be formed as a nut configured to engage the threads 52 of the shank 50. However, in this embodiment, the entire interior surface of the central aperture 102 is not threaded. Rather, the interior surface has a threaded portion 110 and an unthreaded portion 108.

Figure 3:
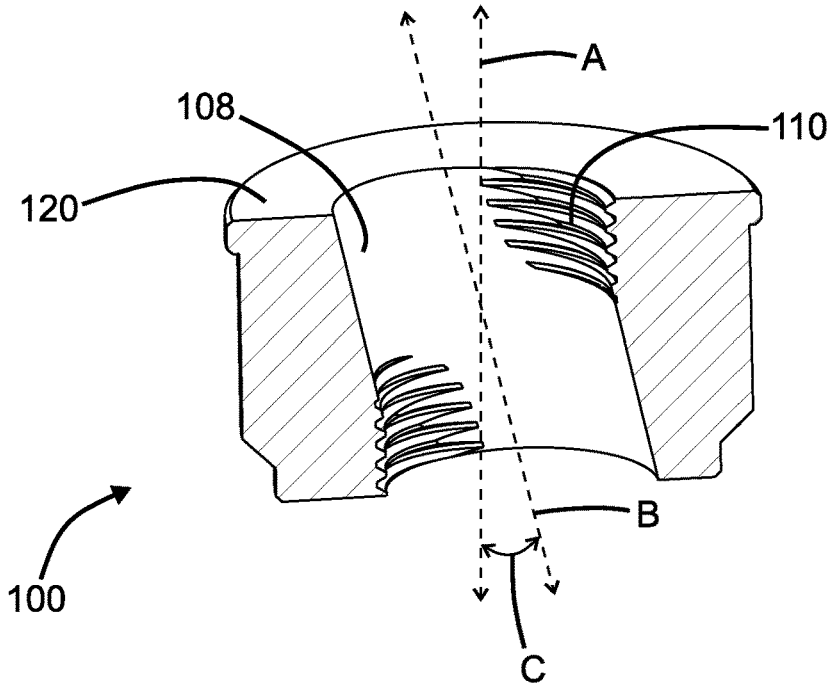
FIG. 3 is an example perspective side cross-sectional view of the fastener of FIG. 2.

As seen most clearly in the cross-sectional view of the fastener 100 depicted in FIG. 3, the central aperture 102 defines first and second axes extending through that aperture. When viewed along a first axis A, which is generally perpendicular to the engagement surface 120, the central aperture 102 has an apparent size (e.g., diameter) that is complementary to and would cause engagement of the threaded portion 110 with the threads 52 on the shank 50. However, when viewed along a second axis B, which is generally angled relative to the engagement surface 120 (e.g., at an angle C relative to axis A), the aperture 102 will have an apparent diameter that is greater than a major diameter of the threaded shank 50.

Figure 4:
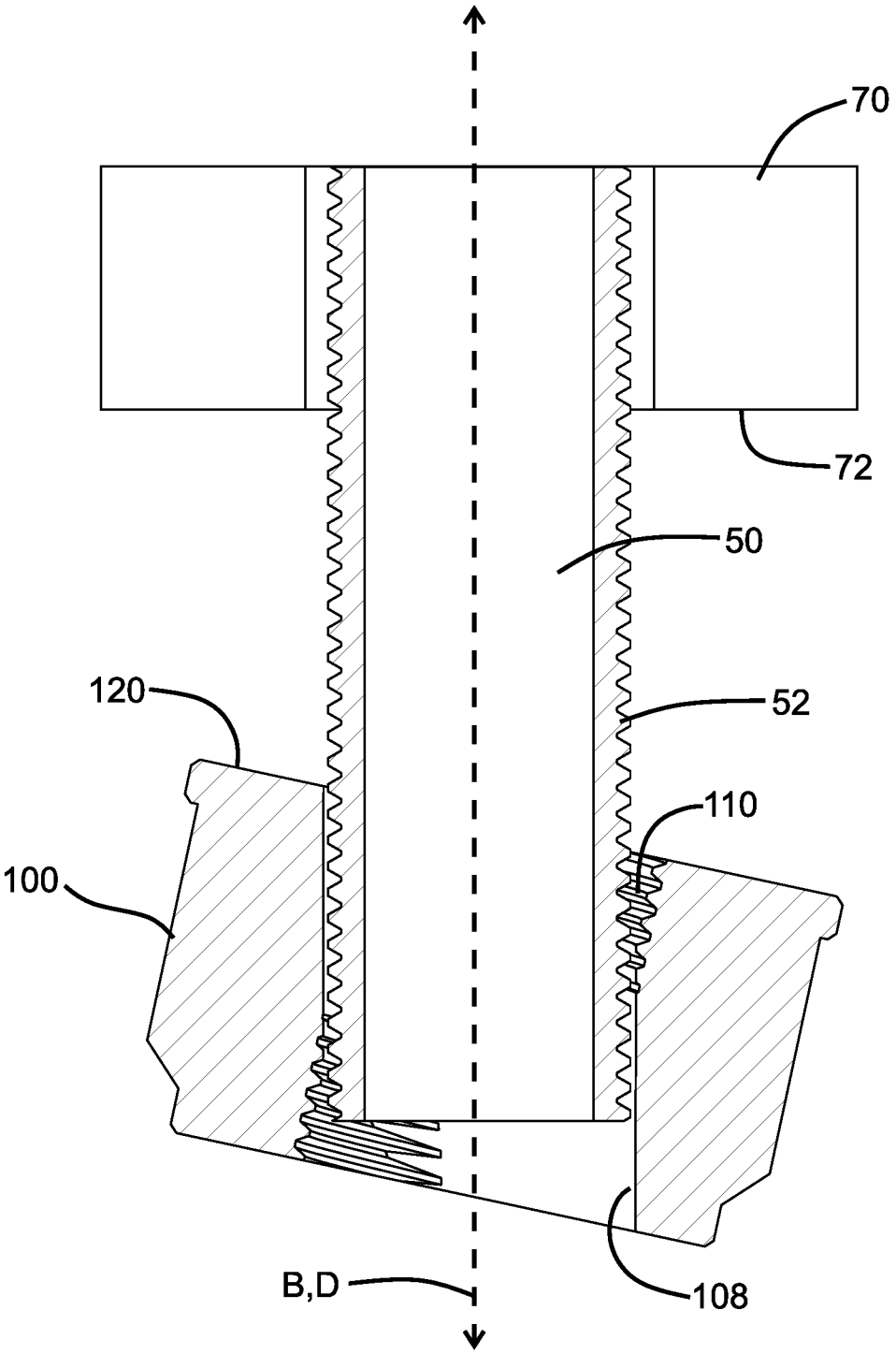
FIG. 4 is a first schematic cross-sectional view of installation of the fastener over a threaded shank with the fastener in a thread disengaged posture.
Figure 5:
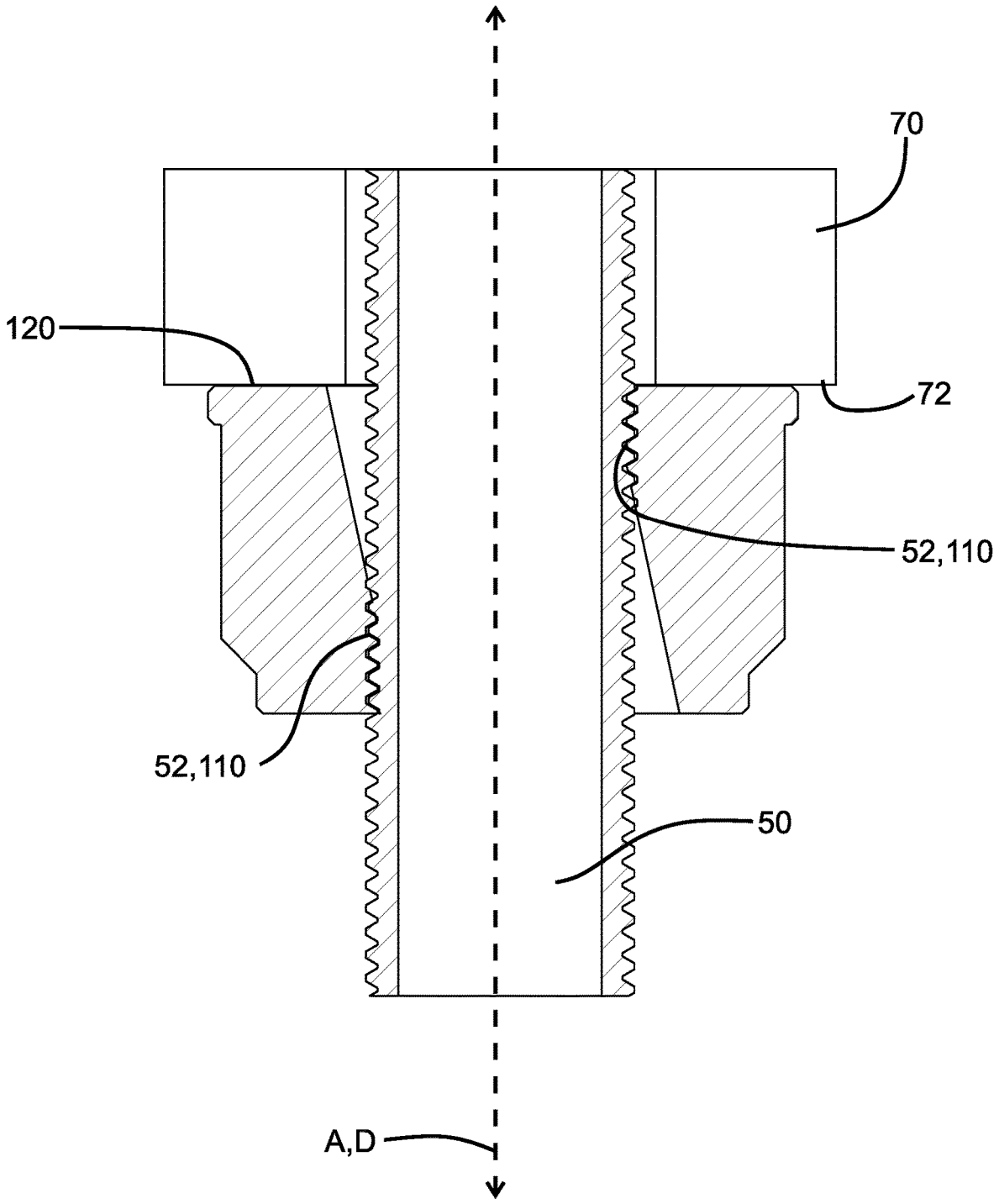
FIG. 5 is a first schematic cross-sectional view of installation of the fastener over a threaded shank with the fastener in a thread engaged posture as the fastener approaches an underside of a mounting surface.

Accordingly, when the fastener 100 is placed around the shank 50 and postured at an angle such that axis B is parallel to a central axis of the shank (e.g., axis D, seen in FIG. 4), the fastener 100 may slide freely along the shank 50 without engagement between the threaded portion 110 and threads 52. Specifically, in such a posture (a "first posture" as provided in this embodiment) the unthreaded portion 108 of the interior surface may slide along the threads 52 of the shank 50, and therefore the fastener 100 is not required to be rotated to advance the fastener 100 along the length of the shank 50. However, when the fastener 100 is placed around the shank 50 and postured such that axis A is parallel to a central axis of the shank (e.g., axis D, as seen in FIG. 5), the fastener is no longer able to freely slide along the shank 50. Rather, in this posture (a "second posture" as provided in this embodiment) the threaded portion 110 of the interior surface of the fastener 100 within the central aperture 102 will engage with the threads 52 of the shank 50. Accordingly, when the fastener 100 is in the second posture as seen in FIG. 5, the fastener 100 will require rotation to move along the shank in the axial direction (along axis D).

In use, the fastener 100 may be utilized to quickly install a faucet assembly including faucet 12 and fastener 100. For example, an installer may insert a threaded shank 50 through an opening in a mounting surface 70 (e.g., a countertop or sink), and below the mounting surface, may slide the fastener 100 over any supply tubes or other hoses (e.g., supply tubes 30*a-b*) extending through the shank 50. The installer may then orient the fastener 100 in a first posture (e.g., as seen in FIG. 4), such that the engagement surface 120 is oriented toward an underside 72 of the mounting surface 70 and the unthreaded portions 108 of the interior surface of the central aperture 102 are in alignment with or otherwise closest to the shank threads 52. The installer may then slide the fastener 100 along the shank 50 toward the underside 72 of the mounting surface 70 without requiring rotation of the fastener 100. As the fastener 100 approaches the underside 72 of the mounting surface 70, the installer may reposition the fastener 100 from the first posture to the second posture (e.g., as seen in FIG. 5) such that the threaded portions 110 of the interior surface of the central aperture 102 are engaged with the shank threads 52. The installer may then rotate the fastener 100, for example 1-2 rotations, via an outer surface 122 to tighten the fastener against the underside 72 of the mounting surface 70. Accordingly, the installer may be able to quickly secure the fastener 100 against the underside 72 of the mounting surface 70 without requiring the faster 100 to be rotated to advance the fastener along the entire length of the shank 50 exposed below the mounting surface 70.

It is noted that, as part of the installation process, as the fastener 100 approaches and initially contacts the underside 72 of the mounting surface 70, the fastener will naturally reorient itself at least partially between the first posture and the second posture due to contact between the underside 72 and the engagement surface 120. Furthermore, as the installer rotates the fastener 100 and the threaded portion 110 initially engages the threads 52, such engagement will naturally cause of the fastener 100 to continue to move toward the second posture as it is rotated and thereby tightened against the underside 72 of the mounting surface 70.

Referring now to FIGS. 6-14 generally, a second example embodiment of a fastener 200 is shown, which may be used as fastener 60 in the context of the faucet assembly 10 of FIG. 1. In this example, seen in particular in FIGS. 6-8, the fastener 200 is a two piece construction, including a threaded piece 202 and a locking piece 204. Joined together, the threaded piece 202 and the locking piece 204 form a nut, having an aperture 201 extending therethrough. The aperture 201 is, as with the embodiment seen in FIGS. 2-5, sized to receive the shank 50 of the faucet 12.

Figure 8:
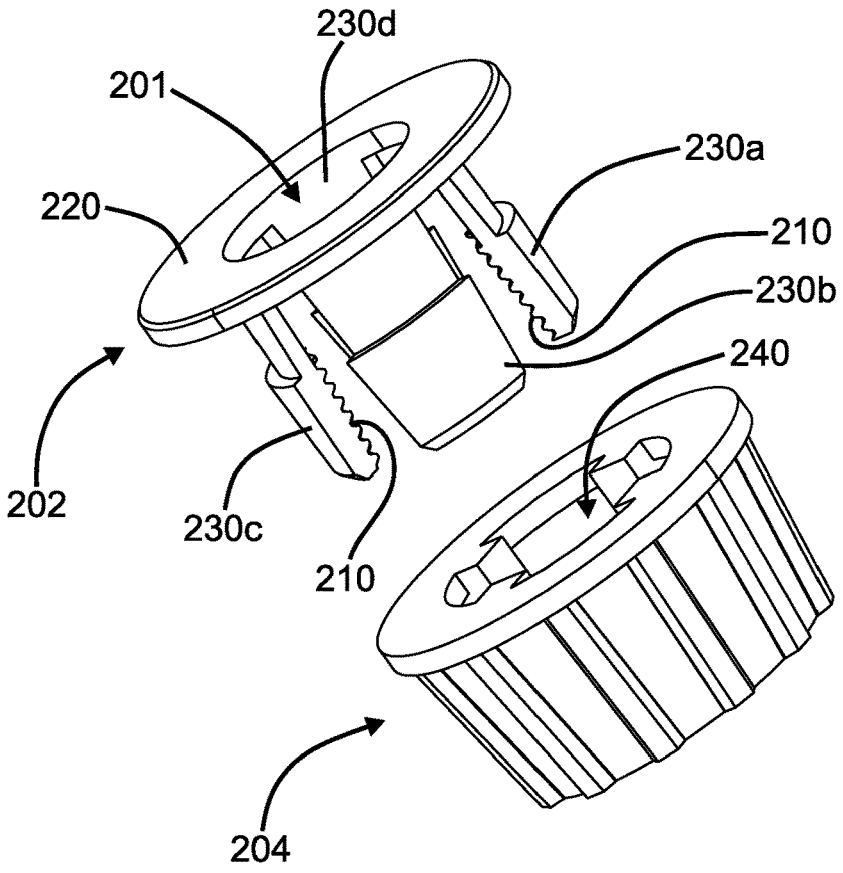
FIG. 8 is an exploded view of the fastener of FIG. 6.
Figure 9:
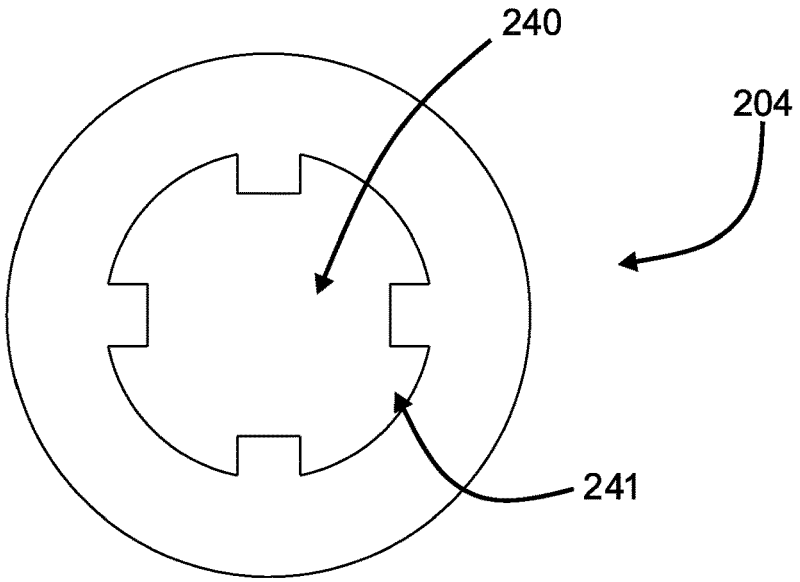
FIG. 9 is a top plan view of a portion of the fastener of FIG. 6.
Figure 10:
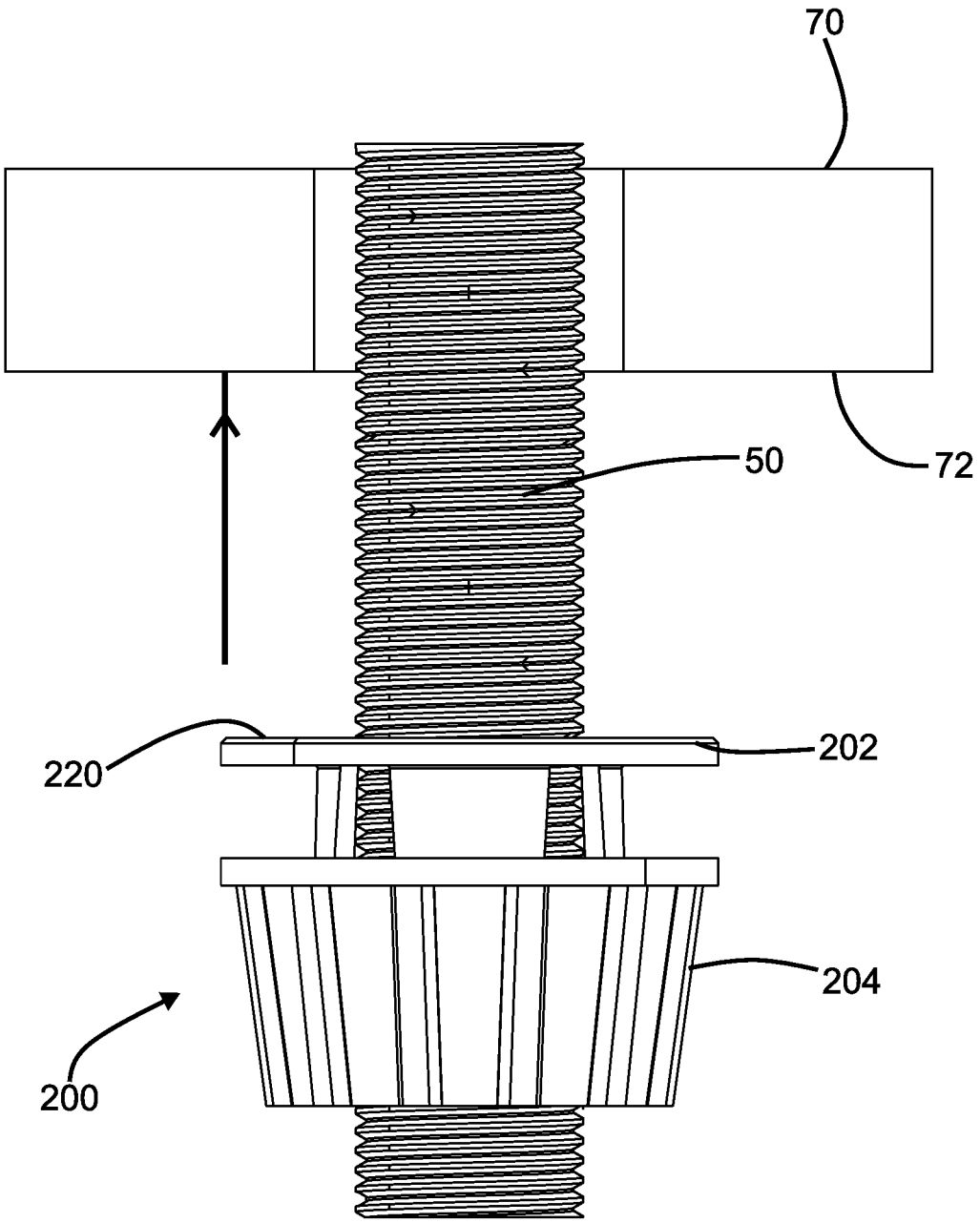
FIG. 10 is a schematic side perspective view of a portion of a faucet assembly including a threaded shank extending through a countertop having the fastener of FIG. 6 positioned thereon, with the fastener in a thread disengaged posture.

As seen most clearly in FIG. 8, the threaded piece 202 includes an engagement surface 220 for engaging with an underside 72 of a mounting surface 70. A plurality of tabs 230*a-d* extend from the engagement surface 220, and may be inserted into an aperture 240 of the locking piece 204. Each of the tabs is angled slightly outwardly, and has a threaded interior surface 210 disposed thereon. In the example shown, the aperture 240 includes a plurality of slots 241 (seen in FIG. 9) extending inward from a top side 243 of the locking piece 204, and which are sized to receive the corresponding tabs 230*a-d*. Accordingly, when the tabs 230 are inserted into corresponding slots 241, the threaded piece 202 and locking piece 204 are not rotatable relative to each other, but instead, allow an installer to grip an outer surface 222 of the locking piece 204 to rotate both the locking piece 204 and threaded piece 202.

Figure 6:
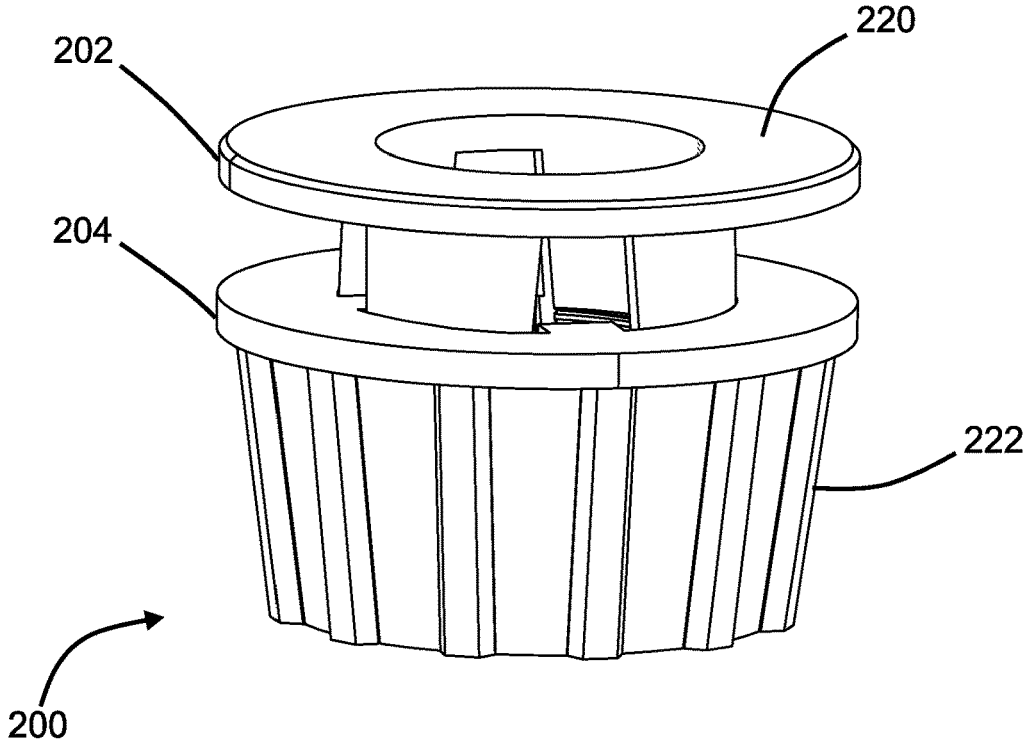
FIG. 6 is an example perspective view of a fastener usable with a threaded shank to mount a faucet to a mounting surface in a thread disengaged posture, in accordance with a second example embodiment.
Figure 7:
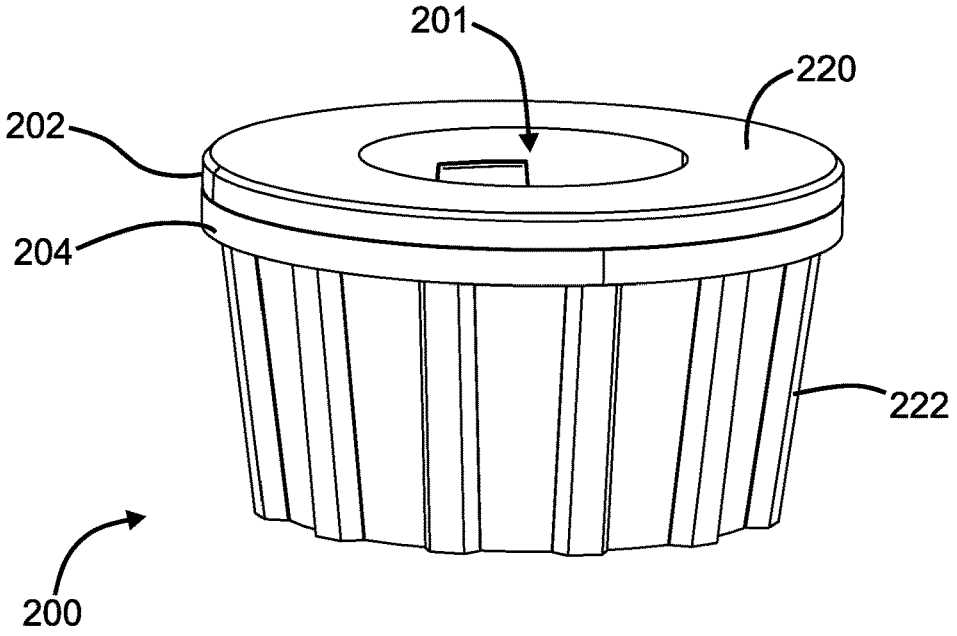
FIG. 7 is an example perspective view of the fastener of FIG. 6 in a thread engaged posture.

As seen in FIGS. 6-7, the fastener 200 is positionable in a first posture, seen in FIG. 6, and in a second posture seen in FIG. 7. The first posture corresponds generally to a thread disengaged posture, in which the fastener 200 is freely slidable along a threaded shank 50. The second posture corresponds generally to a threaded engaged posture, in which the fastener 200 compresses the tabs 230*a-d* toward the threaded shank, causing the threaded interior surfaces 210 of the tabs to engage with threads 52 on the shank 50. In this instance, rather than pivoting or angling the fastener, as with the fastener 100 of FIGS. 2-5, to adjust between the first and second postures, the fastener 200 is manipulated to slide the locking piece 204 toward the engagement surface 220 of the threaded piece 202, thereby causing compression of the tabs 230*a-d* for engaging with the threaded interior surface 210, as discussed specifically below.

A method of installation of a faucet 12 using fastener 200 is schematically depicted in FIGS. 10-14. As first seen in FIG. 10, the fastener 200 is initially slid over the shank 50 in a thread disengaged posture, such as the posture depicted in FIG. 6. In this posture, the fastener 200 is freely slidable along the shank 50, since the threaded interior surface 210 on tabs 230*a-d* are not compressed toward the threads 52 of the shank 50.

Figure 11:
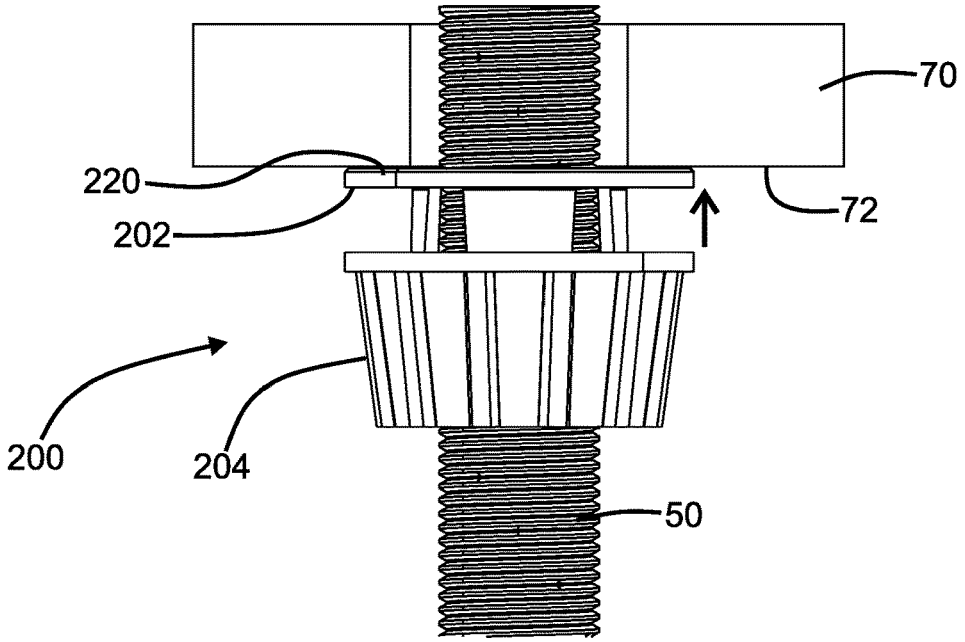
FIG. 11 is a schematic side perspective view of the portion of the faucet assembly as seen in FIG. 10, after sliding the fastener along the threaded shank.

As seen in FIG. 11, as the fastener approaches the underside 72 of the mounting surface 70, the engagement surface 220 may contact the underside 72. Because an installer will typically grip the fastener 200 by the locking piece 204, when the engagement surface 220 contacts the underside 72, the continued motion of the installer will cause compression of the locking piece 204 toward the engagement surface 220, and may therefore move the locking piece 204 relative to the threaded piece 202 from the first posture (seen in FIG. 11) to the second posture (seen in FIG. 12), thereby engaging the threads 52 of the shank 50 with the threaded interior surface 210 on tabs 230*a-d*. Once the threads 52, 210 are engaged with each other, the installer may rotate the fastener 200, thereby tightening the fastener against the underside 72 and thereby affixing the faucet 12 to the mounting surface 70.

Figure 12:
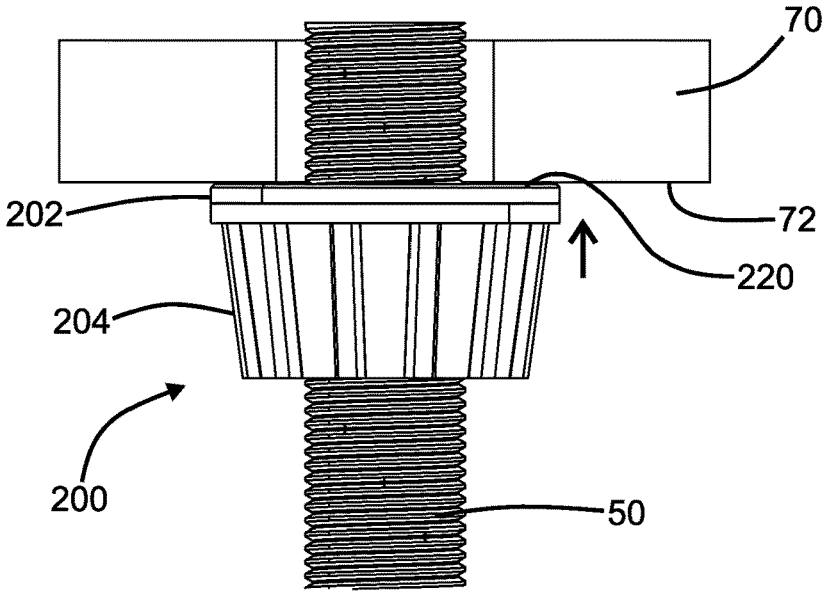
FIG. 12 is a schematic side perspective view of the faucet assembly as seen in FIG. 10 after adjusting the posture of the fastener to a thread engaged posture.
Figure 13:
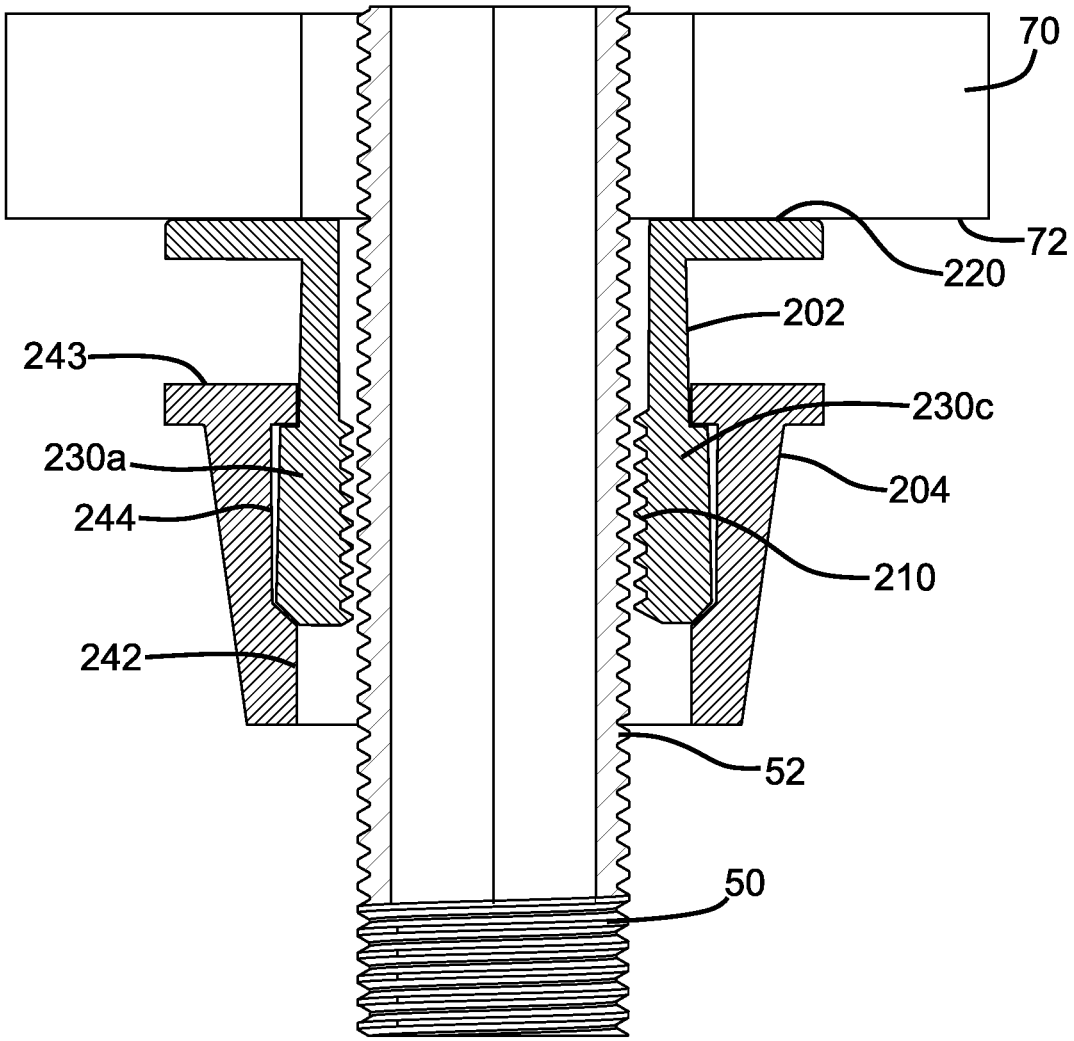
FIG. 13 is a side cross-sectional view of the portion of the faucet assembly as seen in FIG. 11.
Figure 14:
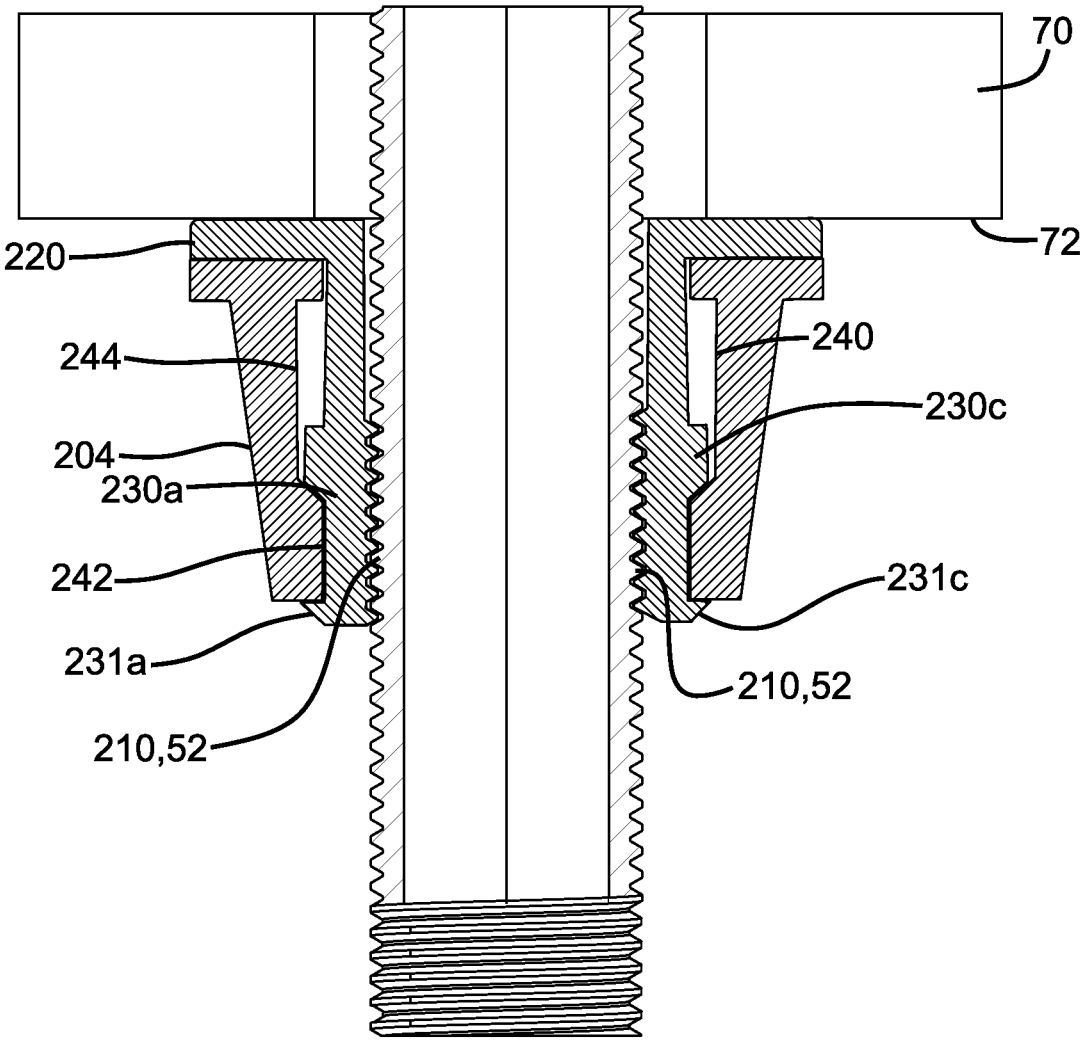
FIG. 14 is a side cross-sectional view of the portion of the faucet assembly as seen in FIG. 12.

A particular mechanism by which the tabs 230*a-d* are compressed toward the threads 52 of the shank 50 is illustrated in the cross-sectional views of the shank 50 and fastener 200 seen in FIGS. 13-14. In particular, FIG. 13 generally corresponds to the positioning of the fastener 200 seen in FIG. 11. In this posture, tabs 230*a-d* are positioned within wider portions 244 of slots 241, thereby allowing the tabs to not be compressed toward the shank 50. However, in FIG. 14, the fastener 200 is positioned as seen in FIG. 12, and placed in the second (engaged) posture. In this configuration, a narrowed portion 242 of each slot 241 biases each of the tabs 230 toward the threads 52 by pressing against an outside surface of each tab, respectively. Accordingly, when the threaded piece 202 and the locking piece are in a first posture relative to each other (i.e., partially separated in the axial direction), the tabs 230*a-d* are not biased inward in a first posture relative to the shank, and the effective diameter of aperture 201 is greater than a major diameter of the threaded shank 50. Therefore, in this configuration, the fastener may freely slide along the shank. However, when the threaded piece 202 and the locking piece 204 are in a second posture relative to each other, the tabs 230*a-d* are biased inward to a second posture relative to the shank, and the effective diameter of aperture 201 is narrowed to cause engagement between threaded interior surface 210 and threads 52 of the shank.

In some embodiments, and as seen specifically in FIG. 14, each of the tabs 230*a-d* has a clip 231*a-d* at an end portion of the respective tab. Accordingly, after installation of the fastener 200, the threaded piece 202 and locking piece 204 will remain in the second posture until manually adjusted (e.g., by removing the fastener 200 from the shank 50 and manually depressing the tabs 230*a-d* inwardly to disengage the respective clips 231*a-d* from an outer, or bottom, edge of the locking piece 204.

The various embodiments described above are provided by way of illustration only and should not be construed to be limiting in any way. Various modifications can be made to the embodiments described above without departing from the true spirit and scope of the disclosure.

The invention claimed is:

1. A faucet assembly comprising:

a faucet having a faucet body comprising a base and a spout;

a cylindrical shank extending from the base and having one or more water supply lines extending therethrough between the spout and a water supply, the shank defining a central axis extending in a first direction and including a threaded exterior surface; and a fastener including a cylindrical aperture formed, at least in part, by an interior surface, where at least a portion of the interior surface includes a complementary threading to the threaded exterior surface of the shank, the fastener being manually adjustable to change a relative posture between the interior surface and the threaded exterior surface of the shank when positioned around the shank between a first posture and a second posture, wherein, in the first posture, the interior surface is positioned away from the shank and the fastener is freely slidable along the threaded exterior surface of the shank in the first direction, and in the second posture, the portion of the interior surface including the complementary threading is adjacent to and engaged with the threaded exterior surface of the shank;

the fastener comprising:

a threaded piece including a flanged engagement surface having a first side and an opposite second side, the first side configured to engage with an underside of a mounting surface, the second side including a plurality of tabs extending therefrom, each of the plurality of tabs extending away from the flanged engagement surface and including the portion of the interior surface with the complementary threading; and a locking piece at least partially surrounding the plurality of tabs, wherein in the first posture, the locking piece is spaced apart from the second side of the flanged engagement surface and movable in the first direction toward the second side to compress the plurality of tabs toward the second posture, wherein in the second posture, the locking piece is immediately adjacent the second side of the flanged engagement surface, and wherein the locking piece includes first and second interior surfaces, wherein the first interior surface is adjacent to an outer side of the plurality of threaded tabs when the plurality of threaded tabs are in the first posture, wherein the second interior surface applies a biasing force to the outer side of the plurality of threaded tabs when the plurality of threaded tabs are in the second posture, and wherein the fastener includes a clip extending radially outward from an end of one or more of the threaded tabs opposite of the engagement surface, the clip retaining the second interior surface engaged to the outer side of the plurality of threaded tabs.

2. The faucet assembly of claim 1, wherein the cylindrical aperture extends through the fastener from a top side defined by the first side of the threaded piece to a bottom side of the fastener.

3. The faucet assembly of claim 1, wherein the fastener does not include any biasing member between the threaded piece and the locking piece.

4. The faucet assembly of claim 1, wherein the first interior surface is a first inner circumferential surface and the second interior surface is a second inner circumferential surface, the first inner circumferential surface having a diameter greater than the second inner circumferential surface.

5. The faucet assembly of claim 1, wherein the fastener has an exterior surface having one or more grip features protruding therefrom.

6. A method of installing a faucet including a faucet body comprising a base, a spout, and a cylindrical shank extending from the base and defining a central axis, the method comprising:

inserting the cylindrical shank of the faucet through a hole in a mounting surface, the mounting surface being one of a countertop or a sink, the cylindrical shank having a threaded exterior surface;

sliding one or more water supply lines extending from the cylindrical shank through a cylindrical aperture of a fastener, the cylindrical aperture formed, at least in part, by an interior surface extending along the central axis of the shank, where at least a portion of the interior surface includes a complementary threading to the threaded exterior surface of the shank, wherein the fastener includes a threaded piece including a flanged engagement surface having a first side and an opposite second side, the second side includes a plurality of tabs extending therefrom, each of the plurality of tabs extending away from the flanged engagement surface and including the portion of the interior surface with the complementary threading, and a locking piece at least partially surrounding the plurality of tabs, wherein the locking piece includes an inner surface having a wider portion and a narrowed portion axially adjacent one another along the central axis of the shank and facing the plurality of tabs, the wider portion having a greater diameter than the narrowed portion;

manually positioning the fastener at a first posture relative to the shank, the first posture positioning the interior surface away from the threaded exterior surface of the shank, and wherein in the first posture, the locking piece is spaced apart from the second side of the flanged engagement surface and each of the plurality of tabs are disposed at least partially within the wider portion of the locking piece;

while maintaining the fastener in the first posture, sliding the fastener along the threaded exterior surface of the shank toward an underside of the mounting surface;

at a position approaching the underside of the mounting surface, manually adjusting a posture of the fastener from the first posture to a second posture along the central axis of the shank via engaging the first side of the flanged engagement surface with the underside of the mounting surface and compressing the plurality of tabs to engage the threaded exterior surface of the shank with the complementary threading of the interior surface, wherein in the second posture, the locking piece is immediately adjacent the second side of the flanged engagement surface such that each of the plurality of tabs are disposed at least partially within the narrowed portion of the locking piece; and tightening the fastener against the underside of the mounting surface by rotating the fastener along the threaded exterior surface, thereby affixing the faucet to the mounting surface.

7. The method of claim 6, wherein, while sliding the fastener along the threaded exterior surface of the shank, the fastener is not required to be rotated along threads of the threaded exterior surface of the shank.

8. The method of claim 6, wherein manually adjusting a posture of the fastener comprises moving the locking piece in a first direction to compress the plurality of threaded tabs toward the second posture.

9. The method of claim 6, further comprising engaging a clip extending radially outward from an end of one or more of the plurality of tabs opposite of the flanged engagement surface, when the fastener is in the second posture.

10. A faucet assembly comprising:

a faucet having a faucet body comprising a base and a spout;

a cylindrical shank extending from the base and having one or more water supply lines extending therethrough between the spout and a water supply, the shank defining a central axis extending in a first direction and including a threaded exterior surface, the threaded exterior surface of the shank having a major diameter; and a fastener including a cylindrical aperture formed, at least in part, by an interior surface extending along the central axis of the shank, where at least a portion of the interior surface includes a complementary threading to the threaded exterior surface of the shank, the fastener comprising:

a threaded piece including a flanged engagement surface having a first side and an opposite second side, the first side configured to engage with an underside of a mounting surface, the second side including a plurality of tabs extending therefrom, each of the plurality of tabs extending away from the flanged engagement surface and including the portion of the interior surface with the complementary threading; and a locking piece at least partially surrounding the plurality of tabs, wherein the locking piece includes an inner surface having a wider portion and a narrowed portion axially adjacent one another along the central axis of the shank and facing the plurality of tabs, the wider portion having a greater diameter than the narrowed portion, the fastener being manually adjustable to change a relative posture between the interior surface and the threaded exterior surface of the shank when positioned around the shank between a first posture and a second posture, wherein, in the first posture, each of the plurality of tabs are disposed at least partially within the wider portion of the locking piece, and the fastener has an interior diameter that, when viewed in a direction along the central axis, is greater than the major diameter of the shank, and the locking piece is spaced apart from the second side of the flanged engagement surface and movable along the central axis toward the second side to compress the plurality of tabs toward the second posture, and in the second posture, each of the plurality of tabs are disposed at least partially within the narrowed portion of the locking piece such that the interior diameter, when viewed in a direction along the central axis, is not greater than the major diameter of the shank, and the locking piece is immediately adjacent the second side of the flanged engagement surface.

11. The faucet assembly of claim 10, wherein, in the second posture, the interior diameter is complementary to the major diameter of the threaded exterior surface, thereby engaging the threaded exterior surface of the shank.

12. The faucet assembly of claim 10, wherein the wider portion of the locking piece is adjacent to an outer side of the plurality of tabs when the plurality of tabs are in the first posture, and wherein the narrowed portion of the locking piece applies a biasing force to the outer side of the plurality of tabs when the plurality of threaded tabs are in the second posture.

13. The faucet assembly of claim 10, wherein the fastener has an exterior surface having one or more grip features protruding therefrom.

14. The faucet assembly of claim 10, wherein the fastener includes a clip extending radially outward from an end of one or more of the plurality of tabs opposite of the flanged engagement surface, the clip retaining the narrower portion engaged to an outer side of the plurality of tabs.

* * * * *